US005467593A

United States Patent [19]

Vincent et al.

[11] Patent Number: 5,467,593

[45] Date of Patent: Nov. 21, 1995

[54] METHOD OF ELECTRONIC FUEL INJECTION FEEDBACK CONTROL

[75] Inventors: Michael T. Vincent, Novi; Terry R. Gutermuth, St. Clair Shores; Robert E. Lawrie, Whitmore Lake; Richard K. Moote, Ann Arbor; Mark A. Simonich, Highland; James R. Tamm, Ann Arbor, all of Mich.

[73] Assignee: Chrysler Corporation, Highland Park, Mich.

[21] Appl. No.: 238,095

[22] Filed: May 4, 1994

[51] Int. Cl.[6] ..... F01N 3/20

[52] U.S. Cl. ..... 60/274; 60/276; 60/285; 123/696

[58] Field of Search ..... 60/274, 276, 285; 123/696

[56] References Cited

U.S. PATENT DOCUMENTS 5,003,944 4/1991 Moote et al. .
5,003,952 4/1991 Weglarz et al. .
5,003,953 4/1991 Weglarz et al. .
5,272,872 12/1993 Grutter ..... 60/285
5,319,921 6/1994 Gopp ..... 60/285
5,363,647 11/1994 Ohuchi ..... 60/285

*Primary Examiner*—Douglas Hart
*Attorney, Agent, or Firm*—Mark P. Calcaterra

[57] ABSTRACT

A method of feedback control for an electronic fuel injection system in an internal combustion engine includes the steps of calculating a front $O_2$ sensor switching voltage threshold based on a signal from a front $O_2$ sensor upstream of a catalyst in an exhaust system for the engine and from a rear $O_2$ sensor downstream of the catalyst, comparing a voltage output of the front $O_2$ sensor to the calculated front $O_2$ sensor switching voltage threshold to determine if a fuel/air ratio of the engine is rich or lean, and decreasing or increasing an amount of fuel to the engine by fuel injectors of the electronic fuel injection system if the fuel/air ratio is determined rich or lean, respectively.

19 Claims, 1 Drawing Sheet

METHOD OF ELECTRONIC FUEL INJECTION FEEDBACK CONTROL

BACKGROUND OF THE INVENTION

1. Field of the Invention

The present invention relates generally to electronic fuel injection systems for internal combustion engines in automotive vehicles and, more particularly, to a method of feedback control for an electronic fuel injection system in an internal combustion engine for an automotive vehicle.

2. Description of the Related Art

Modern automotive vehicles have an exhaust system which includes a three-way catalyst to reduce HC, CO and $NO_x$ emissions from an internal combustion engine in the vehicle simultaneously if the fuel/air ratio of the feedgas to the engine is maintained within a narrow window. To accomplish this, automotive vehicles have used a single $O_2$ sensor located upstream of the catalyst for fuel/air feedback control.

With the current single $O_2$ sensor for feedback control, a voltage output signal of the $O_2$ sensor (which has a non-linear proportionality to the fuel/air ratio) is compared to a calibrateable voltage threshold to determine if the fuel/air ratio is rich or lean. When the voltage output signal is determined to switch from lean to rich (for example, to go from below to above the $O_2$ sensor switch point calibration), an $O_2$ controller kicks lean and beings to ramp lean until the $O_2$ sensor voltage output signal changes from rich to lean. Then, the $O_2$ controller kicks rich and begins to ramp rich until the $O_2$ sensor voltage output signal changes again from lean to rich.

While the use of the current single $O_2$ sensor has worked well, the $O_2$ sensor is subject to both short and long term errors that affect fuel/air control. The short term errors are due to shifts in the $O_2$ sensor voltage output signal based on exhaust gas temperature and composition. The long term errors are due to high exhaust gas temperatures and to potentially poisonous exhaust emissions. These factors can lead to a slowed $O_2$ sensor response, and a shift in the voltage of the output signal relative to the fuel/air ratio with time.

SUMMARY OF THE INVENTION

It is, therefore, one object of the present invention to provide two $O_2$ sensors for fuel/air feedback control to improve catalyst efficiency and reduce exhaust emissions.

It is another object of the present invention to provide a method of electronic fuel injection feedback control based on the use of two $O_2$ sensors.

To achieve the foregoing objects, the present invention is a method of feedback control for an electronic fuel injection system in an internal combustion engine. The method includes the steps of calculating a front $O_2$ sensor switching voltage threshold based on a signal from a front $O_2$ sensor upstream of a catalyst in an exhaust system for the engine and from a rear $O_2$ sensor downstream of the catalyst. The method also includes the steps of comparing a voltage output of the front $O_2$ sensor to the calculated front $O_2$ sensor switching voltage threshold to determine if a fuel/air ratio of the engine is rich or lean and decreasing or increasing an amount of fuel to the engine by fuel injectors of the electronic fuel injection system if the fuel/air ratio is determined rich or lean, respectively.

One advantage of the present invention is that two $O_2$ sensors are provided for fuel/air feedback control to improve catalyst efficiency and reduce exhaust emissions of the automotive vehicle. Another advantage of the present invention is that one $O_2$ sensor is located upstream of the catalyst and another $O_2$ sensor is located downstream of the catalyst to vary the upstream $O_2$ sensor voltage switch point (instead of a fixed value over the life of the automotive vehicle). Yet another advantage of the present invention is that the downstream $O_2$ sensor maintains the proper fuel/air ratio exiting the catalyst as close as possible to the peak catalyst efficiency point, even as the upstream $O_2$ sensor ages. Still another advantage of the present invention is that a method is provided for electronic fuel injection feedback control based on the use of two $O_2$ sensors. A further advantage of the present invention is that the downstream $O_2$ sensor is not subjected to severe temperatures that the upstream sensor is exposed to. A still further advantage of the present invention is that the downstream $O_2$ sensor should maintain proper switching over the life of the automotive vehicle and its output can be used to affect the switching of the more vulnerable upstream $O_2$ sensor.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
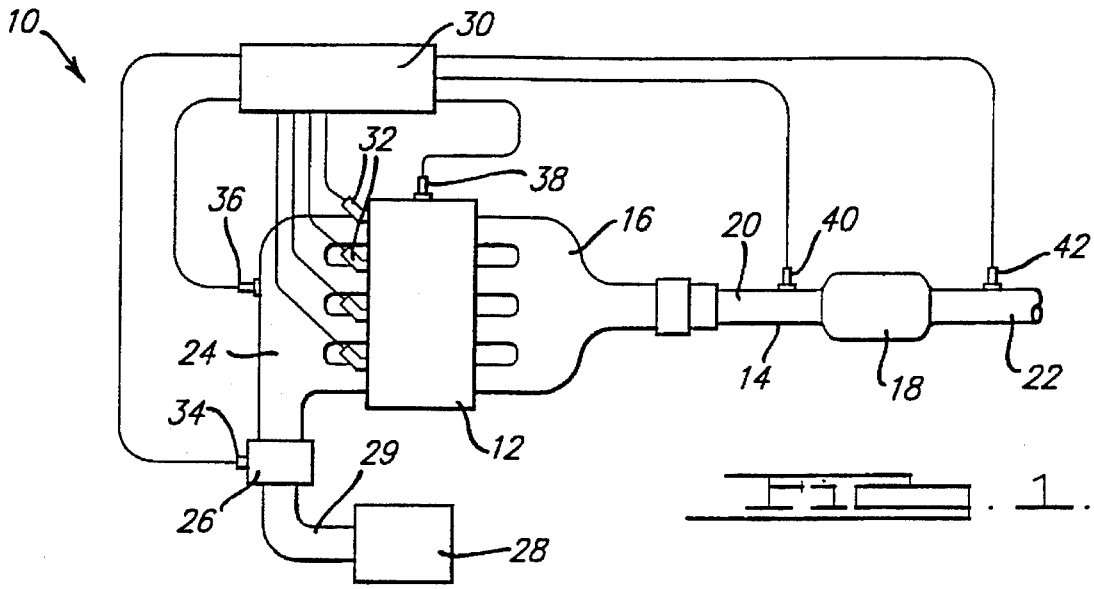
FIG. 1 is a schematic diagram of an electronic fuel injection system, according to the present invention, illustrated in operational relationship with an internal combustion engine and exhaust system of an automotive vehicle.

Referring to FIG. 1, an electronic fuel injection system 10, according to the present invention, is illustrated in operational relationship with an internal combustion engine 12 and an exhaust system 14 of an automotive vehicle (not shown). The exhaust system 14 includes an exhaust manifold 16 connected to the engine 12 and a catalyst 18 such as a catalytic converter connected by an upstream conduit 20 to the exhaust manifold 16. The exhaust system 14 also includes a downstream conduit 22 connected to the catalyst 18 and extending downstream to a muffler (not shown). The engine 12 includes an intake manifold 24 connected thereto and a throttle body 26 connected to the intake manifold 24. The engine 12 also includes an air filter 28 connected by a conduit 29 to the throttle body 26. It should be appreciated that the engine 12 and exhaust system 14 are conventional and known in the art.

The electronic fuel injection system 10 includes an engine controller 30 having fuel injector outputs 32 connected to corresponding fuel injectors (not shown) of the engine 12 which meter an amount of fuel to cylinders (not shown) of the engine 12. The electronic fuel injection system 10 also includes a throttle position sensor 34 connected to the throttle body 26 and the engine controller 30 to sense an angular position of a throttle plate (not shown) in the throttle body 26. The electronic fuel injection system 10 includes a manifold absolute pressure (MAP) sensor 36 connected to the intake manifold 24 and the engine controller 30 to sense MAP. The electronic fuel injection system 10 also includes a coolant temperature sensor 38 connected to the engine 12 and the engine controller 30 to sense a temperature of the engine 12. The electronic fuel injection system 10 further includes an upstream or front $O_2$ sensor 40 connected to the upstream conduit 20 of the exhaust system 14 and a downstream or rear $O_2$ sensor 42 connected to the downstream conduit 20 of the exhaust system 14. The front and rear $O_2$ sensors 40 and 42 are also connected to the engine controller 30 to sense the $O_2$ level in the exhaust gas from the engine 12. It should be appreciated that the engine controller 30 and sensors 34,36,38,40 and 42 are conventional and known in the art.

Figure 2:
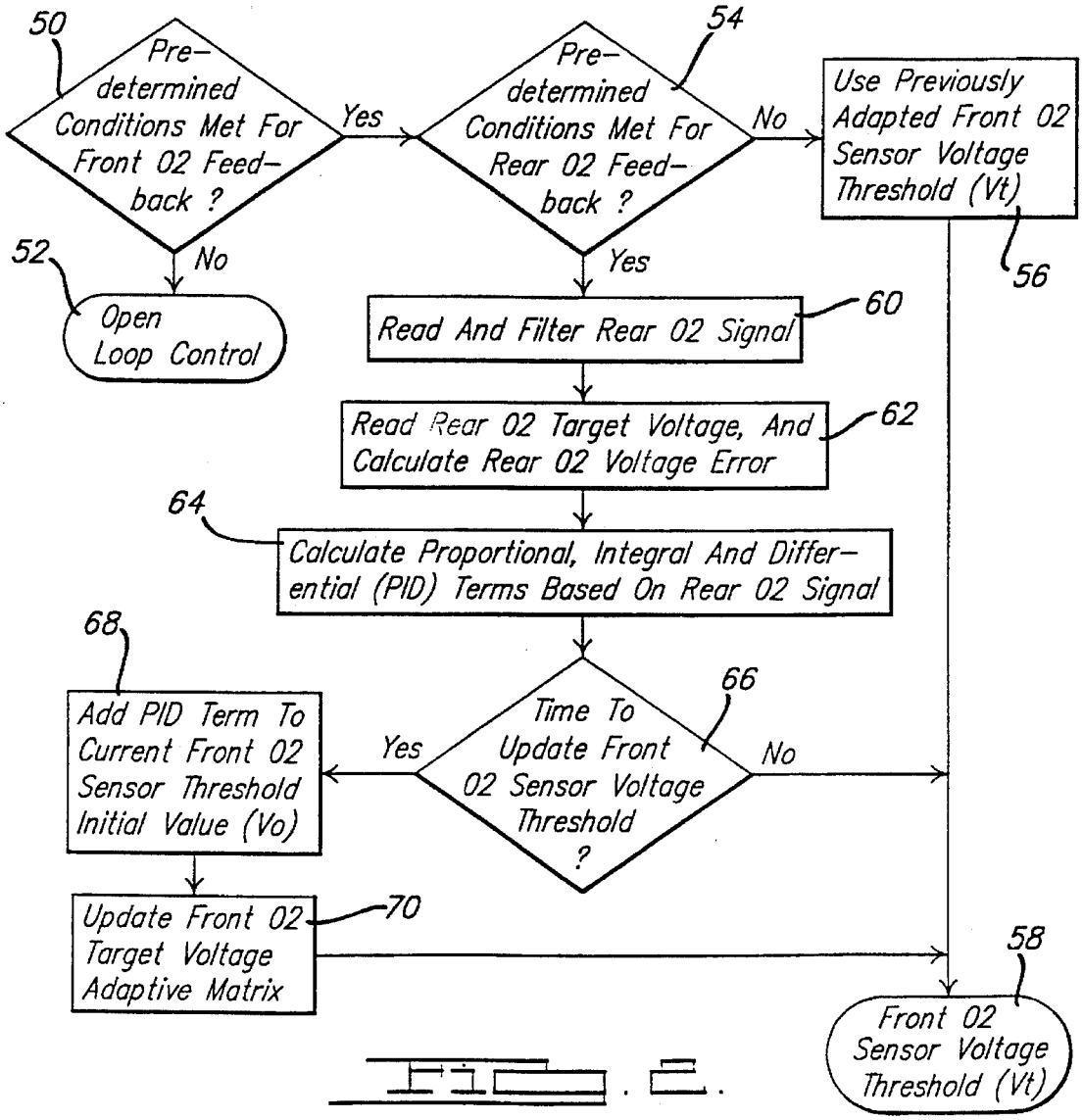
FIG. 2 is a flowchart of a method of feedback control, according to the present invention, for the electronic fuel injection system of FIG. 1.

Referring to FIG. 2, a method of feedback control, according to the present invention, is illustrated for the electronic fuel injection system 10. The methodology begins in diamond 50 and determines whether predetermined conditions have been met for feedback from the front $O_2$ sensor 40 such as throttle angle and MAP being within predetermined ranges as sensed by the sensors 34 and 36, respectively. If not, the methodology advances to bubble 52 and performs open loop control of the fuel injection system 10. If so, the methodology advances to diamond 54 and determines whether predetermined conditions have been met for feedback from the rear $O_2$ sensor 42 such as throttle angle and MAP being within predetermined ranges. If not, the methodology advances to block 56 and uses a previously adapted front $O_2$ sensor switching voltage threshold (Vt) which is an initial value Vo based on either a previous front $O_2$ sensor switching voltage threshold or a RAM location from a front $O_2$ sensor switching target voltage adaptive matrix stored in memory of the engine controller 30. The methodology then advances to bubble 58 and uses the front $O_2$ sensor switching voltage threshold (Vt) for controlling the electronic fuel injection system 10 to be described.

In diamond 54, if the predetermined conditions have been met for feedback from the rear $O_2$ sensor 42, the methodology advances to block 60. In block 60, the methodology reads and filters the voltage output signal from the rear $O_2$ sensor 42. The methodology then advances to block 62 and reads a rear $O_2$ target voltage and calculates a rear $O_2$ voltage error. The engine controller 30 reads the rear $O_2$ target voltage based on the engine operating conditions and is obtained from a 3×3 matrix of RPM and MAP. The engine controller 30 calculates the rear $O_2$ voltage error by subtracting the actual voltage of the output signal from the rear $O_2$ sensor 42 of block 60 from the rear $O_2$ target voltage. The rear $O_2$ voltage error (target voltage-actual voltage) is passed through a linear PID control routine to produce the front sensor switching voltage threshold (Vt) changes. The methodology advances to block 64 and calculates the proportional, integral and differential (PID) terms based on rear $O_2$ signal as follows:

$$\text{PID term}=(Kp*\Delta V)+\int(Ki*\Delta Vdm)-(Kd*\Delta Vi)$$

The proportional term for the PID term is (Kp*ΔV) where Kp is a calibration constant for the proportional term and ΔV is the rear $O_2$ voltage error calculated in block 62. The integral term for the PID term is ∫(Ki*ΔVdm) where Ki is a calibration constant for the integral term and ΔVdm is ΔV,(M*time). ΔV is the rear $O_2$ voltage error of block 62, M is a RAM location of mass airflow and time is the elapsed time from last interrupt based on current RPM of the engine 12. The integral is essentially the summation of the voltage error multiplied by the successive difference measured in the mass airflow term ∫ΔVdm=Σ[ΔV*(M*time]. The mass airflow term compensates for the transport time and gas mixing that occurs through the engine 12 and exhaust system 14 ahead of the rear $O_2$ sensor 42 as well as oxygen storage capacity within the catalyst 18. The derivative term for the PID term is (Kd*ΔVi) where Kd is a calibration constant for the derivative term and ΔVi is the change between current filtered rear $O_2$ sensor voltage of block 60 and the previous filtered rear $O_2$ sensor voltage of block 60. It should be appreciated that the PID term is a proportional gain element multiplied by the rear $O_2$ sensor voltage error, plus an integral gain element multiplied by both a mass airflow term and the voltage error, minus a derivative gain term multiplied by the instantaneous rear $O_2$ sensor voltage error.

From block 64, the methodology advances to diamond 66 and determines whether it is time to update the front $O_2$ sensor switching voltage threshold (Vt). If not, the methodology advances to bubble 58 previously described. If so, the methodology advances to block 68 and adds the PID term calculated in block 64 to the current front $O_2$ sensor switching voltage threshold initial value ($V_o$) as follows:

$$Vt=Vo+\text{PID Term}$$

The methodology then advances to block 70 and updates the front $O_2$ sensor switching target voltage adaptive matrix for Vo with Vt. The methodology then advances to bubble 58 previously described.

After bubble 58, the methodology compares a voltage output from the front $O_2$ sensor 40 to the front $O_2$ sensor switching voltage threshold (Vt) to determine if the fuel/air ratio of the engine is rich or lean. The methodology then decreases or increases the amount of fuel to the engine 12 by the fuel injectors in response to signals from the engine controller 30 via the fuel injector outputs 32.

Accordingly, the rear $O_2$ sensor 42 is used to modify the front $O_2$ sensor switching voltage threshold or switch point (instead of a fixed value over the life of the vehicle). The rear $O_2$ sensor output voltage is monitored, filtered, and compared to a target voltage to calculate a rear $O_2$ voltage error. The rear $O_2$ voltage error is integrated over time and adjustments are made to the front $O_2$ sensor switch point to reduce the error in the rear $O_2$ sensor voltage.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of feedback control for an electronic fuel injection system in an internal combustion engine, said method comprising the steps of:

calculating a front $O_2$ sensor switching voltage threshold based on a signal from a front $O_2$ sensor upstream of a catalyst in an exhaust system for the engine and from a rear $O_2$ sensor downstream of the catalyst;

comparing a voltage output of the front $O_2$ sensor to the calculated front $O_2$ sensor switching voltage threshold to determine if a fuel/air ratio of the engine is rich or lean; and decreasing or increasing an amount of fuel to the engine by fuel injectors of the electronic fuel injection system if the fuel/air ratio is determined rich or lean, respectively.

2. A method as set forth in claim 1 including the step of reading and filtering a voltage signal from the rear $O_2$ sensor prior to said step of calculating.

3. A method of feedback control for an electronic fuel injection system in an internal combustion engine, said method comprising the steps of:

reading and filtering a voltage signal from the rear $O_2$ sensor;

obtaining a target voltage for the rear $O_2$ sensor based on RPM and MAP of the engine;

calculating a front $O_2$ sensor switching voltage threshold based on a signal from a front $O_2$ sensor upstream of a catalyst in an exhaust system for the engine and from a rear $O_2$ sensor downstream of the catalyst;

comparing a voltage output of the front $O_2$ sensor to the calculated front $O_2$ sensor switching voltage threshold to determine if a fuel/air ratio of the engine is rich or lean; and decreasing or increasing an amount of fuel to the engine by fuel injectors of the electronic fuel injection system if the fuel/air ratio is determined rich or lean, respectively.

4. A method as set forth in claim 3 including the step of calculating a rear $O_2$ voltage error based on the voltage signal and target voltage.

5. A method as set forth in claim 4 wherein said step of calculating comprises calculating a proportional, integral and differential (PID) term based on the rear $O_2$ voltage error.

6. A method as set forth in claim 5 wherein said step of calculating further comprises obtaining an initial voltage (Vo) for the front $O_2$ sensor and adding the PID term to Vo.

7. A method as set forth in claim 6 including the step of determining whether to update the front $O_2$ sensor switching voltage threshold prior to said step of obtaining.

8. A method as set forth in claim 6 including the step of updating the front $O_2$ sensor switching target voltage adaptive matrix with the front $O_2$ sensor switching voltage threshold.

9. A method as set forth in claim 8 including the step of using the calculated front $O_2$ switching voltage threshold for the front $O_2$ sensor.

10. A method as set forth in claim 2 including the step of determining whether predetermined conditions have been met for feedback from the rear $O_2$ sensor prior to said step of reading and filtering.

11. A method of feedback control for an electronic fuel injection system in an internal combustion engine, said method comprising the steps of:

determining whether predetermined conditions have been met for feedback from the rear $O_2$ sensor;

reading and filtering a voltage signal from the rear $O_2$ sensor;

calculating a front $O_2$ sensor switching voltage threshold based on a signal from a front $O_2$ sensor upstream of a catalyst in an exhaust system for the engine and from a rear $O_2$ sensor downstream of the catalyst;

comparing a voltage output of the front $O_2$ sensor to the calculated front $O_2$ sensor switching voltage threshold to determine if a fuel/air ratio of the engine is rich or lean; and decreasing or increasing an amount of fuel to the engine by fuel injectors of the electronic fuel injection system if the fuel/air ratio is determined rich or lean, respectively; and using previously adapted front $O_2$ sensor switching voltage threshold if predetermined conditions have not been met for feedback from the rear $O_2$ sensor.

12. A method as set forth in claim 10 including the step of determining whether predetermined conditions have been met for feedback from the front $O_2$ sensor prior to said step of determining.

13. A method of feedback control for an electronic fuel injection system in an internal combustion engine, said method comprising the steps of:

determining whether predetermined conditions have been met for feedback from the rear $O_2$ sensor;

reading and filtering a voltage signal from the rear $O_2$ sensor;

calculating a front $O_2$ sensor switching voltage threshold based on a signal from a front $O_2$ sensor upstream of a catalyst in an exhaust system for the engine and from a rear $O_2$ sensor downstream of the catalyst;

comparing a voltage output of the front $O_2$ sensor to the calculated front $O_2$ sensor switching voltage threshold to determine if a fuel/air ratio of the engine is rich or lean; and decreasing or increasing an amount of fuel to the engine by fuel injectors of the electronic fuel injection system if the fuel/air ratio is determined rich or lean, respectively;

determining whether predetermined conditions have been met for feedback from the front $O_2$ sensor; and using open loop control if the predetermined conditions have not been met for feedback from the front $O_2$ sensor.

14. A method of feedback control for an electronic fuel injection system in an internal combustion engine, said method comprising the steps of:

reading and filtering a voltage signal from a rear $O_2$ sensor downstream of a catalyst in an exhaust system for the engine and obtaining a target voltage for the rear $O_2$ sensor based on RPM and MAP of the engine;

calculating a front $O_2$ sensor switching voltage threshold based on a signal from a front $O_2$ sensor upstream of the catalyst and from the voltage signal from the rear $O_2$ sensor;

comparing a voltage output of the front $O_2$ sensor to the calculated front $O_2$ sensor voltage threshold to determine if a fuel/air ratio of the engine is rich or lean; and decreasing or increasing an amount of fuel to the engine by fuel injectors of the electronic fuel injection system if the fuel/air ratio is determined rich or lean, respectively.

15. A method as set forth in claim 14 including the step of calculating a rear $O_2$ voltage error based on the voltage signal and target voltage.

16. A method as set forth in claim 15 wherein said step of calculating comprises calculating a proportional, integral and differential (PID) term based on the rear $O_2$ voltage error.

17. A method as set forth in claim 16 wherein said step of calculating further comprises obtaining an initial voltage (Vo) for the front $O_2$ sensor and adding the PID term to Vo.

18. A method as set forth in claim 17 including the step of determining whether to update the front $O_2$ sensor switching voltage threshold prior to said step of obtaining.

19. A method as set forth in claim 18 including the step of updating a front $O_2$ sensor switching target voltage adaptive matrix with the front $O_2$ switching voltage threshold and using the calculated front $O_2$ switching voltage threshold for the front $O_2$ sensor.

* * * * *

UNITED STATES PATENT AND TRADEMARK OFFICE

CERTIFICATE OF CORRECTION

PATENT NO. : 5,467,593
DATED : Nov. 21, 1995
INVENTOR(S) : Michael T. Vincent, et al It is certified that error appears in the above-identified patent and that said Letters Patent is hereby corrected as shown below:

On title page, item [75] before "all of Mich."
Add the following Inventors;
--Gregory T. Weber, Commerce Twp,
Michael W. Weglarz, Macomb Twp,
Gary L. Seitz, Chelsea, and
Christopher P. Thomas, West Bloomfield,--

Signed and Sealed this

Third Day of April, 2001

Nicholas P. Godici

*Attest:*

NICHOLAS P. GODICI

*Attesting Officer*

*Acting Director of the United States Patent and Trademark Office*